US010563833B2

(12) United States Patent
Feil et al.

(10) Patent No.: US 10,563,833 B2
(45) Date of Patent: Feb. 18, 2020

(54) SOCKET WITH MOVEABLY MOUNTED OPTICAL UNIT

(71) Applicant: OSRAM GmbH, Munich (DE)

(72) Inventors: Thomas Feil, Iggingen (DE); Daniel Weissenberger, Giengen (DE)

(73) Assignee: OSRAM BETEILIGUNGSVERWALTUNG GmbH, Grunwald (DE)

( * ) Notice: Subject to any disclaimer, the term of this patent is extended or adjusted under 35 U.S.C. 154(b) by 0 days.

(21) Appl. No.: 16/106,106

(22) Filed: Aug. 21, 2018

(65) Prior Publication Data

US 2019/0063706 A1 Feb. 28, 2019

(30) Foreign Application Priority Data

Aug. 22, 2017 (DE) ..... 10 2017 214 668

(51) Int. Cl.

| | |
|---|---|
| ***F21S 41/19*** | (2018.01) |
| ***F21S 43/19*** | (2018.01) |
| ***F21S 45/47*** | (2018.01) |
| ***F21S 43/14*** | (2018.01) |
| *F21S 41/141* | (2018.01) |

(52) U.S. Cl.

CPC ..... *F21S 41/192* (2018.01); *F21S 43/14* (2018.01); *F21S 43/195* (2018.01); *F21S 45/47* (2018.01); *F21S 41/141* (2018.01)

(58) Field of Classification Search

CPC ..... F21S 41/141; F21S 41/143; F21S 41/192; F21S 41/194; F21S 41/24; F21S 41/29; F21S 43/14; F21S 43/15; F21S 43/195; F21S 43/237; F21S 43/243; F21S 43/249; F21S 43/27; F21S 45/47; F21S 45/50

See application file for complete search history.

(56) References Cited

U.S. PATENT DOCUMENTS

| | | | | |
|---|---|---|---|---|
| 3,688,103 | A * | 8/1972 | Daumuller | F21S 41/196 362/523 |
| 4,623,958 | A * | 11/1986 | Van der Linde | F21S 48/1109 313/113 |
| 5,859,732 | A * | 1/1999 | Ozaki | G02B 7/023 348/E9.008 |
| 9,200,787 | B2 * | 12/2015 | Le Bars | F21V 19/04 |
| 2013/0107529 | A1 | 5/2013 | Liao et al. | |
| 2016/0061404 | A1 * | 3/2016 | Kosugi | F21S 43/195 362/516 |

FOREIGN PATENT DOCUMENTS

| | | | |
|---|---|---|---|
| DE | 102014104503 | A1 | 10/2015 |
| DE | 102015206471 | A1 | 10/2016 |
| DE | 102016113617 | A1 | 1/2018 |

OTHER PUBLICATIONS

German Search Report based on application No. 102017214668.0 ( 9 pages) dated Apr. 20, 2018 (Reference Purpose Only).

* cited by examiner

*Primary Examiner* — Tracie Y Green

(57) ABSTRACT

A socket for a lamp includes a connection which is prepared for retaining at least one light source, an optical element which is prepared for optical coupling to the light source, and a bearing. The optical element is movably mounted by the bearing for adaptation to a position of a light exit unit of a connectable light source.

15 Claims, 1 Drawing Sheet

SOCKET WITH MOVEABLY MOUNTED OPTICAL UNIT

CROSS-REFERENCE TO RELATED APPLICATION

This application claims priority to German Patent Application Serial No. 10 2017 214 668.0, which was filed Aug. 22, 2017, and is incorporated herein by reference in its entirety.

TECHNICAL FIELD

Various embodiments relate generally to a socket for a lamp, a lamp and a vehicle headlamp.

BACKGROUND

Conventional headlamps for vehicles are headlamps, wherein standardizations may apply to such headlamps, such as for example standardizations by the International Technical Commission (IEC). Provided therein can be, for example, standards relating to an "exchangeable light source (XLS)." Such a light source can be used, for example, for an additional light function in a vehicle, such as a fog light function, daytime running light function, low-beam function, high-beam function, tail light function, signal light function, position light function, turn light function, brake light function, accent illumination function, effect light-emitting means, and for further, non-automotive applications, e.g. as light-emitting means in projectors for effect light illumination, entertainment illumination, architainment illumination, outdoor illumination, offshore illumination, illumination for wind turbines, ambient illumination, medical and therapeutic illumination or illumination for horticulture or animal husbandry. For example, the standardization can relate to referencing and rotation prevention of the light source in the headlamp.

A conventional illumination device has a semiconductor light source arrangement that is arranged on a carrier, a housing for receiving the semiconductor light source arrangement, a heat sink for cooling the semiconductor light source arrangement, and an electrical connection element for supplying the semiconductor light source arrangement with energy, wherein the heat sink has a heat sink portion that is arranged in a cutout of the housing and forms a placement surface for the carrier of the semiconductor light source arrangement, wherein the heat sink furthermore has a second heat sink portion, which is arranged with an accurate fit between the housing and the electrical connection element, and wherein furthermore the electrical connection element has electrical contacts that are guided through a perforation in the placement surface and form a press fit with the carrier of the semiconductor light source arrangement. Arranged on the housing are here preferably locking elements that serve to form bayonet locking with a socket. Likewise with preference, a sealing ring is provided, which is arranged in a receptacle of the housing.

Another conventional illumination device has a plurality of semiconductor light sources, which are arranged on a surface of a carrier, and a common optical unit for the semiconductor light sources, which covers the semiconductor light sources, characterized in that the common optical unit is configured to be rotationally symmetric with respect to an axis of symmetry that is perpendicular to the surface of the carrier and the semiconductor light sources are arranged on the carrier symmetrically with respect to the axis of symmetry. The illumination device here preferably has, in addition to an assembly circuit board which serves as the carrier, inter alia a housing and a heat sink. The heat sink preferably has a hollow-cylindrically shaped heat sink portion, which is arranged in a cutout, that is to say ring opening, of the housing, and a planar placement surface for the assembly circuit board on its side facing the (first) end face of the housing. At its second end side, the ring-shaped housing preferably has a ring-shaped flange portion which protrudes radially outwardly from an outer lateral surface of the ring-shaped housing, forms a placement surface for a sealing ring and together with locking elements constitutes a ring-shaped groove for receiving the sealing ring made of silicone or rubber. The for example three locking elements are preferably arranged along the outer circumference of the ring-disk-shaped first end surface and protrude radially from the outer lateral surface of the ring-shaped housing and form a bayonet lock with correspondingly shaped counterpieces of a socket of a motor vehicle lamp. To activate the bayonet lock, the illumination device is preferably inserted into the socket of the motor vehicle lamp and subsequently rotated clockwise about the ring axis of the housing. To limit said rotational movement, a locking element preferably has a stop, which rests in the socket or installation opening of the motor vehicle lamp after the bayonet locking. The bayonet lock can be embodied with a product-specific key, such that each type of illumination device has its own key and mixups are thus avoided. The necessary contact pressure of the illumination device with respect to the socket is preferably provided by the sealing ring. The sealing ring can be formed for example in the form of an O-ring having a radially internally molded centering lip.

Yet another conventional illumination device for a motor vehicle has at least one semiconductor light source arrangement and means for regulating or controlling the supply current for the at least one semiconductor light source arrangement, wherein the means include at least one resistor element having a temperature-dependent resistance.

When using an exchangeable light source on a vehicle headlamp, the problem occurs that, despite a standardized design of the light source, a relative position of a light exit unit (collective term for a light generator or a light source emitter and/or an optical element) varies, or differs, in dependence on the actually used light source. The problem is exacerbated with an increasing tolerance sensitivity of the optical system. The narrower a selected or specified tolerance is, the more expensive the production and/or installation generally becomes.

SUMMARY

A socket for a lamp includes a connection which is prepared for retaining at least one light source, an optical element which is prepared for optical coupling to the light source, and a bearing. The optical element is movably mounted by the bearing for adaptation to a position of a light exit unit of a connectable light source.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
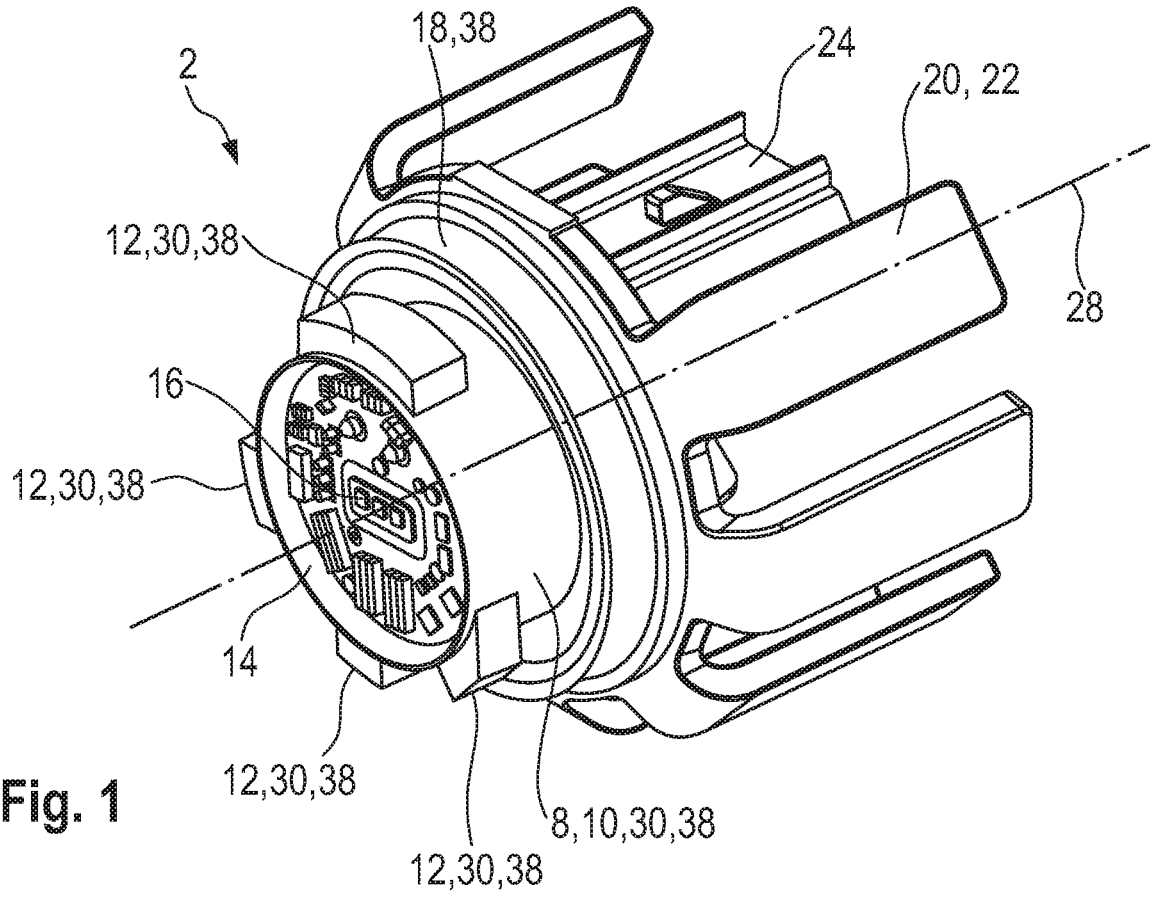
FIG. 1 shows a perspective illustration of a light source, which is usable for a socket according to various embodiments, in accordance with the embodiment.

The following detailed description refers to the accompanying drawings that show, by way of illustration, specific details and embodiments in which the invention may be practiced.

Various embodiments make usable a light source having as widely tolerable a position specification as possible.

Independently claimable is a socket for a lamp, wherein the socket has a connection which is prepared for retaining at least one light source, an optical element which is prepared for optical coupling to the light source, and a bearing, wherein the optical element is movably mounted by the bearing for adaptation to a position of a light exit unit of a connectable or connected light source. Consequently, the optical element can be moved to a widely tolerated position of the light exit unit. At the same time, the optical element can be designed with narrow tolerance requirements with respect to the relative position of the light exit unit of the light source. A "connectable" or "connected" light source is understood here to mean that the light source is not part of the socket, but adaptation is preferably effected only when the light source has been connected or during the connection of the light source.

The light source can be designed, for example, as: an incandescent lamp; a halogen lamp, a halogen retrofit light emitting diode (LED) lamp, an LED lamp for vehicle applications, such as the OSRAM XLS LED lamp; a discharge lamp (high intensity discharge (HID)), e.g. a gas discharge lamp; a light-emitting diode (LED), a pixelated LED (such as for example the OSRAM EVIYOS-COB-Matrix light source) or generally a light-emitting means with matrix arrangements; a laser (such as for example a system operating on the principle of laser activated remote phosphor (LARP) (NB: the term phosphor in the art also refers to phosphor-free light-emitting substances)); a projector operating on a digital light processing (DLP) principle; an IR radiation source, in particular an IR laser diode; or another apparatus which emits, reproduces and/or generates electromagnetic radiation in and/or partially in and/or near and/or partially near the visible range. A light-emitting diode is e.g. intended to mean an LED having a downstream light-emitting substance for partially converting primary light (emission light of the LED) into secondary light (conversion light of the light-emitting substance); a warm-white light-emitting LED; a cold-white light-emitting LED; an LED operated in full conversion; an LED without a downstream light-emitting substance; a pixelated LED matrix arrangement; an organic LED (OLED) and/or the like. The LED chips may emit white light in the standardized ECE white field of the automobile industry, for example realized by way of a blue emitter and a yellow/green converter.

The light source can be a matrix light source, which has a multiplicity of e.g. regularly arranged light-generating chips or semiconductors and/or semiconductor segments. In this case, the optical element of the socket can exhibit a collective geometry, wherein for example each light source sub-unit of the matrix light source is assigned its own light guide, which is for example for the light entry at the light source sub-unit. Such matrix light sources exhibit an increased light output.

If the light source is an exchangeable light source, it is designed to be prepared for being exchanged. This can also influence a design of the socket.

If the light source is provided with a counter connection that has a mating and/or couplable design with respect to the connection, a particularly easily mountable system can be attained.

If the socket is prepared for connecting a light source of a light source type, wherein the light source type prescribes a relative position between a counterconnection of the light source and the light exit unit, a standardized socket is attained. The above-mentioned XLS standard can be implemented in this way, for example.

If the light source is an XLS module and/or a LARP module, a standardized light source form can be used.

In a development, provision may be made for the connection of the socket and/or the counterconnection of the light source to be selected from a group of connections which contains a bayonet lock, a thread, a clamping device, a slotted pinhole apparatus, a latch, a force-fit apparatus, a form-fit apparatus, a releasable or non-releasable substance-to-substance-fit apparatus and/or a multiplicity thereof and/or a combination thereof. This achieves quick exchangeability of the light source. In a further development, provision may be made for the movability of the bearing to be adapted to the selected connection and/or counterconnection. This produces a synergy between the movability on the one hand and the quick exchangeability on the other, such that costs can be drastically lowered (due to wider tolerances and quicker installation).

The bayonet lock is locked, for example, as follows: By way of example, the substantially rotation-symmetrical light source is axially inserted or displaced into the socket until a base comes into contact with the socket with the interposition of a sealing ring (in general terms: a sealing means). This is followed directly or indirectly by a further axially displacing step, for example by converting, using a thread-type inclination, a rotational movement at the base into an axial displacement of the socket, wherein the interposed sealing means is compressed and twisted with static and/or sliding friction. This is followed directly or indirectly by a further rotating step, wherein the sealing means is or can be twisted further with static and/or sliding friction. Finally, the base locks in the rotational direction relative to the socket by way of a latch and/or by way of a compressive force that has a clamping and/or static-friction effect and is caused by the compression of the sealing means, wherein the base is retained in the socket in the axial direction in the manner of a force fit, form fit, substance-to-substance fit and/or another fit.

If the light exit unit is a light generator and/or optical element, at the light source side an optical element can be integrated in the light source in a manner adaptable to situations and applications.

Provision can be made in a development for the optical element of the socket and/or the optical element of the light source to be selected from the group including a light-diffracting element, a light-refracting element, a light-modifying element, a light-guiding element, a light guide, a reflector, a lens, a TIR optical unit (total internal reflection, an optical construction type), a stop, an at least partially absorbing stop, a filter, a light-scattering element, a light input element, a light converging element (such as a taper optical unit) and/or a multiplicity thereof and/or a combination thereof. Said optical elements have proven and tested properties, and therefore a socket which is able to be adapted to situations and applications can be obtained. A light-modifying element is understood to be for example a color filter, a LARP converter and/or generally a unit which modifies the wavelength and/or intensity. These are merely examples which may currently be provided due to practical considerations, and other light-modifying elements are not necessarily intended to be excluded.

If the optical element has at least also a light-converging function, it is possible in a development to provide a socket with a plurality of connectable light sources. These can then adopt different functions, such as a primary light function (e.g. driving light) and a secondary light function (e.g. what is known as a "coming home function"). For the secondary light function, a different light source type than for the primary light function can be provided.

Provision can be made in a development for the bearing to include an elastic element, which is connected between the connection and the optical element. Hereby, a resiliency can be achieved which influences the movement without limiting it. At the same time, for example, a contact pressure effect can be achieved due to the elasticity, as a result of which for example undesired rattling or the like can be suppressed.

Provision can be made in a development for the elastic element to be selected from the group including an element which acts elastically due to picking up and/or giving off a compressive force and/or a tensile force and/or a bending moment and/or a torsional moment, a spring, a coil spring, a rod spring, a leaf spring, a cup spring, an element made of an elastic, soft elastic and/or rubber elastic material and/or plastics material, an injection-moldable element, an element which is prepared for at least partially embedding the optical element, a composite material, a multiplicity thereof and/or a combination thereof. An element which acts elastically due to picking up and/or giving off a compressive force and/or a tensile force and/or a bending moment and/or a torsional moment can be a tension spring, a compression spring, a flexible spring, a torsion spring or a combination thereof. Said elastic elements have proven elastic properties and/or manufacturing properties and/or durability properties. An element which is prepared for at least partially embedding the optical element can be a foam material, for example. An elastic material can also be silicone.

Provision can be made in a development for the movability and/or the elasticity of the bearing to be prepared for thermal expansion of the socket and/or of the optical element and/or of the light source at least with respect to an operating temperature of the light source. As a result, a particularly reliable socket can be obtained.

Provision may be made in a development for the optical element (of the socket) to include a coupling region, which is prepared for coupling with the light source and/or with the light exit unit of the light source and/or with a counter-coupling region of the light source. As a result, the optical element can be prepared for direct coupling with the light source, light exit unit and/or the counter-coupling region, from which can follow a particularly robust coupling and/or improved coupling with respect to the optical transmission behavior. The coupling can be docking.

If the coupling region is prepared for direct mechanical contact with the light source, efficiency can be increased. Furthermore, optionally providable centering is simplified.

If the coupling region includes an optical function, multiple use can be attained.

Provision can be made in a development for the socket to include at least one stop for limiting the movability and/or the elasticity of the bearing in at least one direction. Hereby, a production-reliable socket which is easy to handle with respect to installation can be obtained.

The socket can include a housing, which is prepared for fixedly connecting the connection to the bearing. Consequently, a socket which is easy to assemble as a component can be obtained.

The socket can be manufactured in a single-component injection molding process. The socket can be manufactured in a two-component injection molding process, wherein for example the housing is one component and the elastic element of the bearing is another component.

Independently claimable is also a lamp having a light source and a socket as described above. Hereby, a system is obtained which can be particularly well adapted and designed efficiently.

Independently claimable is also a vehicle headlamp having at least one socket as described above. A vehicle headlamp is a projector suitable and/or prepared for use in the automotive industry.

A vehicle can be an aircraft or a watercraft or a land vehicle. The land vehicle can be a motor vehicle or a rail vehicle or a bicycle. In various embodiments, the vehicle is a truck or a passenger car or a motorcycle. The vehicle can furthermore be configured as a non-autonomous or partially autonomous or autonomous vehicle.

A headlamp which is suitable and/or prepared for use in the automotive industry may be prepared to be used in a vehicle which is designed according to the standards of the automobile industry in order to be adapted particularly to this relatively specific intended purpose. This suitability can manifest itself, for example, in that all functional parts are designed for the temperature range from −40 to +125° C.

FIG. 1 illustrates a light source 2 in accordance with the embodiment, which is combinable with a socket 4 of a headlamp 6. The headlamp 6 can be used as a tail light, signal light, position light, turning light, brake light, accent light, but also as fog light, daytime running light, low-beam and/or high-beam function or the like of a vehicle (not illustrated). The headlamp 6 is a type of lamp.

The light source 2 has a base 8. The light source 2 may be fastened to the socket 4 by way of the base 8. The base 8 has an approximately circular-cylindrical outer lateral surface 10, from which four key tabs 12 extend radially.

The term "approximately" can mean, for example, that a deviation in the tolerances which are typical in the art, or of up to 5%, can be provided.

At the end side, the base 8 has a circular cylindrical cutout 14, inside which radiation sources in the form of, for example, LEDs 16 and electronics components are arranged. The LEDs 16 can also be referred to as emitters, light generators and/or light-emitting elements. In the present case, three LEDs 16 are present, all three of which can for example emit white light, or which include one LED 16 that emits a yellow light and two LEDs 16 that emit white a light, or which include LEDs 16 that emit respectively a red, a yellow and a blue light, or which have a different configuration.

At a distance from the key tabs 12, the base 8 is surrounded by a sealing ring 18. Furthermore, a heat sink 20 extends from the base 8. Said heat sink has a multiplicity of cooling fins 22, which extend axially away from the base 8 in the opposite direction to radiation that is emitted by the LEDs 16. The cooling fins 22 here surround a connection 24 for the light source 2, which is prepared for the electrical contact.

The socket 4, which is part of the headlamp 6, has a key opening 26, in which a multiplicity of key cutouts (not illustrated) are formed. These cooperate with the key tabs 12, in that the key tabs 12 have a mating shape with respect to the key cutouts viewed in cross section (axial cross section) with respect to a main axis 28 of the base 8 and the socket 4. The key cutouts and the key opening 26 and the outer lateral surface 10 and the key tabs 12 together act as a bayonet lock 30.

Figure 2:
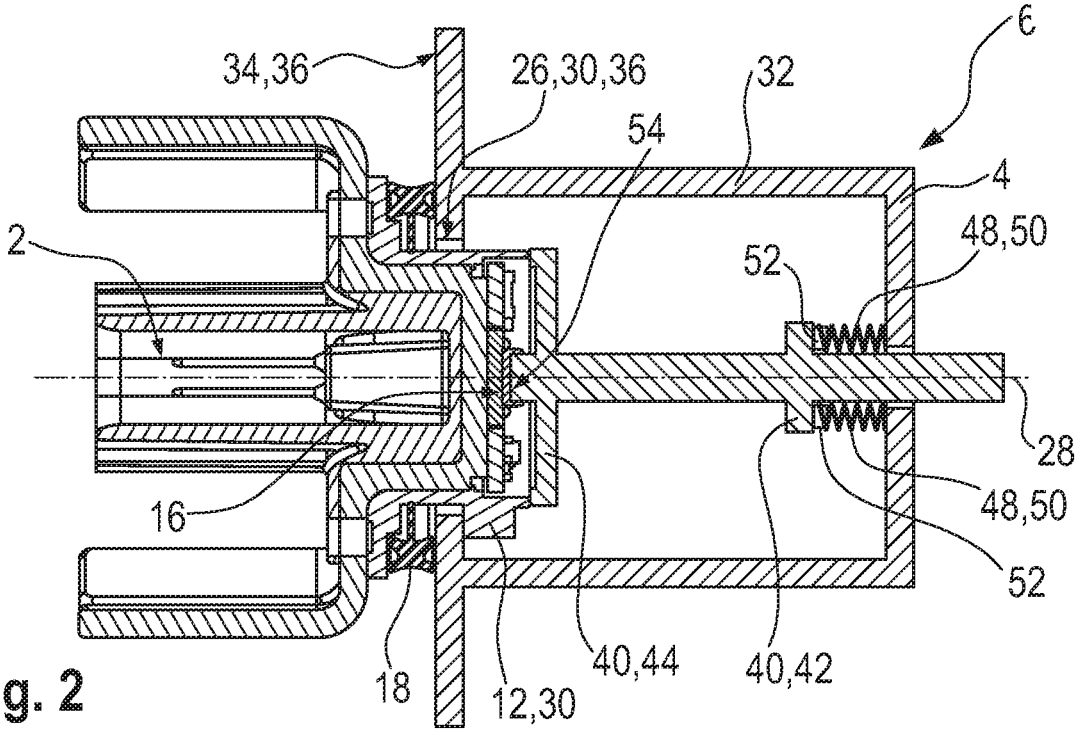
FIG. 2 shows a view in longitudinal section of a socket according to various embodiments and a light source, which is coupled thereto, in accordance with the embodiment.

FIG. 2 shows the headlamp 6 in a longitudinal section through the light source 2 and the socket 4.

The socket 4 has a housing 32, which includes a placement surface 34 which is prepared for the placement of the light source 2. The housing 32 is filled with a condensation-free gas. The placement surface 34 and the key opening 26 with the key cutouts (not illustrated) form a connection 36 which is prepared for retaining the light source 2. The outer lateral surface 10, the key tabs 12 and the sealing ring 18 together form a mating counterconnection 38 with respect to the connection 36. The relative position between the LEDs 16, which are collectively called a light exit unit, and the counterconnection 38 is specified with tolerances by way of a type of the light source 2 shown here.

The socket 4 furthermore includes an optical element 40. The optical element 40 is a light guide which includes a light guide section 42 and a light-guiding and/or transparent connection flange 44. A light guide input coupling surface relates to the connection flange 44. The optical element 40, or more precisely an abutment section 46 formed on the light guide section 42, is connected to a part of the housing 32 via a bearing 48.

The bearing 48 includes an elastic element 50 and a stop 52, which is received therein. The elastic element 50 is kinematically arranged between the housing 32 of the socket 4 and the optical element 40, and is consequently connected between the optical element 40 and the housing 32 and/or elements, such as the connection 36, which are fixed with respect to the housing 32. The elastic element 50 includes two coil springs which are prepared for picking up and giving off a compression force and a tensile force. The bearing 48 is also referred to as a suspension.

The light source 2 is an exchangeable light source. If different light sources 2 are mounted to the socket 4, the position of the light exit unit 16 relative to the socket 4 varies. The reason for this may be variations in the actually produced light sources 2, a setting behavior of the sealing ring 18 or a thermal expansion of the components involved. The non-rigid bearing 48 or the elasticity thereof permits movement of a light entry end 54 of the light guide section 42 or of the optical element 40 and the adaptation thereof to the current position or actual position of the light exit unit 16.

The connection flange 44 is a coupling region of the optical element 40, which is prepared for coupling to the base 8 as a countercoupling region of the light source 2. Optionally, the connection flange 44 and the lateral surface 10 and/or the cutout 14 can be prepared for centering coupling. The connection flange 44 is prepared in the manner of a placement flange for direct mechanical contact (placement) with the base 8 of the light source 2. Because of its light-guiding design, the connection flange 44 can, as an optical function, "collect" light that is emitted by the LEDs 16 and guide it to the light guide section 42.

The LEDs which are combined to form the light exit unit 16 define a light emission area. In various embodiments, the light entry end 54 is located at a distance from the light emission area, with the distance being selected from the group which includes the distances of approximately 0 μm, approximately 10-20 μm, less than approximately 100 μm, at most approximately 100 μm, at least approximately 100 μm and more than approximately 100 μm. The distance of approximately 0 μm is also referred to as being in contact and is a limit case.

LIST OF REFERENCE SIGNS light source 2
socket 4
headlamp 6
base 8
outer lateral surface 10
key tabs 12
cutout 14
LED 16
sealing ring 18
heat sink 20
cooling fin 22
connection 24
key opening 26
main axis 28
bayonet lock 30
housing 32
placement surface 34
connection 36
counterconnection 38
optical element 40
light guide section 42
connection flange 44
abutment section 46
bearing 48
elastic element 50
stop 52
light entry end 54

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A socket for a lamp, the socket comprising:

a connection which is prepared for retaining at least one light source;

an optical element which is prepared for optical coupling to the light source; and a bearing;

wherein the optical element is movably mounted by the bearing for adaptation to a position of a light exit unit of a connectable light source; and wherein a sealing element for being inserted between the light source and the connection is provided, and wherein at least one of the movability or the elasticity of the bearing is adapted to the sealing element.

2. The socket of claim 1, wherein the light source is an exchangeable light source.

3. The socket of claim 1,
wherein the socket is prepared for connecting a light source of a light source type;
wherein the light source type prescribes a relative position between a counterconnection of the light source and the light exit unit.

4. The socket of claim 1,
wherein at least one of the connection of the socket or the counterconnection of the light source is selected from a group of connections which consists of:
a bayonet lock;
a thread;
a clamping device;
a slotted pinhole apparatus;
a latch;
a force-fit apparatus;
a form-fit apparatus;
a releasable substance-to-substance-fit apparatus;
a non-releasable substance-to-substance-fit apparatus;
a multiplicity thereof; and
a combination thereof;
wherein the movability of the bearing is adapted to at least one of the selected connection or counterconnection.

5. The socket of claim 1,
wherein the light exit unit is at least one of a light generator or an optical element.

6. The socket of claim 1,
wherein at least one of the optical element of the socket or the optical element of the light source is selected from a group consisting of:
a light-diffracting element;
a light-refracting element;
a light-modifying element;
a light-guiding element;
a light guide;
a reflector;
a lens;
a TIR optical unit;
a stop;
an at least partially absorbing stop;
a filter;
a light-scattering element;
a light input element;
a light converging element;
a multiplicity thereof; and
a combination thereof.

7. The socket of claim 1,
wherein the bearing includes an elastic element, which is connected between the connection and the optical element.

8. The socket of claim 7,
wherein the elastic element is selected from a group consisting of:
an element which acts elastically due to at least one of picking up or giving off a compressive force or a tensile force or a bending moment or a torsional moment;
a spring;
a coil spring;
a rod spring;
a leaf spring;
a cup spring;
an element made of an elastic;
at least one of soft elastic or rubber elastic material or plastics material;
an injection-moldable element;
an element which is prepared for at least partially embedding the optical element;
a composite material;
a multiplicity thereof; and
a combination thereof.

9. The socket of claim 1,
wherein at least one of the movability or the elasticity of the bearing is prepared for thermal expansion of at least one of the socket or of the optical element or of the light source at least with respect to an operating temperature of the light source.

10. The socket of claim 1,
wherein the optical element includes a coupling region, which is prepared for coupling with at least one of the light source or with the light exit unit of the light source or with a counter-coupling region of the light source.

11. The socket of claim 10,
wherein the coupling region is prepared for direct mechanical contact with the light source.

12. The socket of claim 10,
wherein the coupling region includes an optical function.

13. The socket of claim 1,
wherein the socket includes at least one stop for limiting at least one of the movability or the elasticity of the bearing in at least one direction.

14. A lamp, comprising:
a socket, comprising:
a connection which is prepared for retaining at least one light source;
an optical element which is prepared for optical coupling to the light source; and
a bearing;
wherein the optical element is movably mounted by the bearing for adaptation to a position of a light exit unit of a connectable light source;
the lamp further comprising a light source; and
a sealing element inserted between the light source and the connection, wherein at least one of the movability or the elasticity of the bearing is adapted to the sealing element.

15. A vehicle headlamp, comprising:
a socket, comprising:
a connection which is prepared for retaining at least one light source;
an optical element which is prepared for optical coupling to the light source; and
a bearing;
wherein the optical element is movably mounted by the bearing for adaptation to a position of a light exit unit of a connectable light source; and
wherein a sealing element for being inserted between the light source and the connection is provided, and wherein at least one of the movability or the elasticity of the bearing is adapted to the sealing element.

* * * * *